United States Patent [19]

Minshall et al.

[11] Patent Number: 4,558,687

[45] Date of Patent: Dec. 17, 1985

[54] STOVE

[75] Inventors: Michael Minshall, Toronto; Brian Park, Eganville; Carlos Etchegoyen, Mississauga; Bert Babrovniczky, Don Mills, all of Canada

[73] Assignee: Spacemaker Limited, Canada

[21] Appl. No.: 358,817

[22] Filed: Mar. 16, 1982

[30] Foreign Application Priority Data

Mar. 16, 1981 [CA] Canada ..... 373064

[51] Int. Cl.[4] ..... F24C 1/16

[52] U.S. Cl. ..... 126/59; 126/65; 126/83

[58] Field of Search ..... 126/9 R, 9 B, 23, 29, 126/38, 59, 65, 77, 80, 83, 126, 4, 193, 197, 112, 118, 990, 61, 58, 197

[56] References Cited

U.S. PATENT DOCUMENTS

| | | | |
|---|---|---|---|
| 3,049,071 | 8/1962 | Diack | 126/9 R |
| 4,026,264 | 5/1977 | Herriques | 126/121 |
| 4,117,826 | 10/1978 | Bette | 126/146 |
| 4,213,443 | 7/1980 | Morarde | 126/61 |
| 4,236,501 | 12/1980 | Bitler | 126/197 |
| 4,373,507 | 2/1983 | Schwartz | 126/285 A |

*Primary Examiner*—William E. Lyddane
*Assistant Examiner*—Gerald Anderson
*Attorney, Agent, or Firm*—Jordan B. Bierman

[57] ABSTRACT

It is known to have solid fuel stoves made of cast iron and/or heavy steel. The stove of the present invention has a top section, a bottom section and a cylindrical body section therebetween. These sections define a primary combustion chamber. The top and bottom sections are frusto-conical in cross-section and are, for transport or storage purposes, adapted to nest within the body section. The top, bottom and body sections are preferably made of steel.

7 Claims, 6 Drawing Figures

STOVE

This invention relates to a freestanding solid fuel stove which is adapted for easy storage, shipping and assembly.

There are many different types of solid fuel stoves available: freestanding stoves, stoves adapted to be inserted into existing fireplaces, stoves with cooking surfaces and stoves without, stoves with secondary cumbustion chambers and stoves without, and various other types of stoves. Most of these stoves are manufactured from cast iron and/or heavy steel and as a result are almost completely assembled during the manufacturing process. As a result of the weight and size, these stoves are expensive to store and transport.

It is an object of the present invention to facilitate ease of storage and shipping.

It is another object of the invention to provide a solid fuel, freestanding stove which can be easily assembled by the consumer. As some of the component parts are, for transport or storage purposes, adapted to nest within the main body section, the stove is easier and cheaper to transport or store. Consequently, the cost to the consumer is reduced.

It is a further object of the invention to provide a stove wherein both the heat transfer efficiency and the combustion efficiency can be controlled.

The present invention provides a freestanding stove comprising a body section, a top section and a bottom section. The body section is cylindrical in shape; the top section is adapted to be secured at one end of said body section and the bottom section is adapted to be secured at the opposite end of the body section. These sections thereby define a primary combustion chamber. The top and bottom sections are frusto-conical in cross-section and are, for transport or storages, adapted to nest within the body section.

From another aspect the invention provides a freestanding stove comprising a primary combustion chamber, a secondary combustion chamber and a draft regulating means wherein the draft regulating means comprises at least one adjustable vent opening operatively to regulate draft to the combustion chambers.

From another aspect the present invention provides a freestanding stove comprising a body section, a top section, a bottom section, a baffle means and a draft regulating means, the body section being cylindrical in shape; the top and bottom sections being, for transport or storage purposes, adapted to nest within the body section. The top section is adapted to be secured at one end of the body section and the bottom section is adapted to be secured at the opposite end of the body section, said sections thereby defining a primary combustion chamber. The baffle means is located between the body section and the top section, and with the top section, defines a secondary combustion chamber. The draft regulating means comprises at least one adjustable vent opening operatively to regulate the flow of air to the combustion chambers; whereby the baffle means is adapted to permit air to flow from the adjustable vent opening to the secondary combustion chamber.

There are many different types of stoves available. Some stoves have a high heat transfer efficiency, i.e., the ability to transfer heat from the stove to the air outside the stove. Other stoves have a high combustion efficiency, i.e., the ability to burn virtually all the by-products of the fuel used. In order to achieve a high combustion efficiency, the heat transfer efficiency will decrease, and vice versa. Neither extreme is desirable.

The stove of the present invention has a triple wall construction which is light weight and durable. The body section comprises an inner cylinder of stainless steel, an outer cylinder of mild steel and insulation therebetween. With the use of insulation, both the heat transfer efficiency and the combustion efficiency can be controlled. The use of fireproof ceramic insulation having a thickness of approximately ¼ inch and a density of approximately six pounds provides a very efficient combination.

The stove of the present invention has a cylindrical combustion chamber, which has been found to have advantages over square or rectangular combustion chambers. One advantage is that the circular construction reduces warpage. Another advantage is that the circular reflecting surface concentrates the heat near the centre of the combustion chamber, thereby achieving greater than normal combustion efficiency.

Other objects of this invention will be apparent hereinafter from the specification and from the recital of the appended claims, particularly when read in conjunction with the accompanying drawings.

Figure 1:
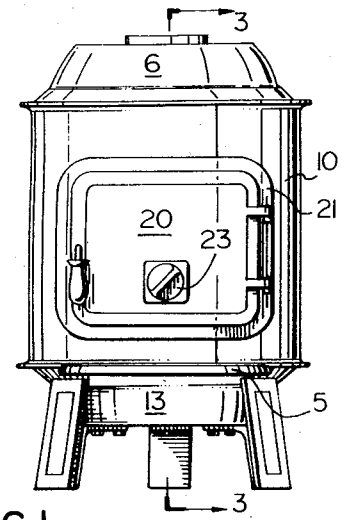
FIG. 1 is a front elevational view of a stove made according to one aspect of this invention.
Figure 2:
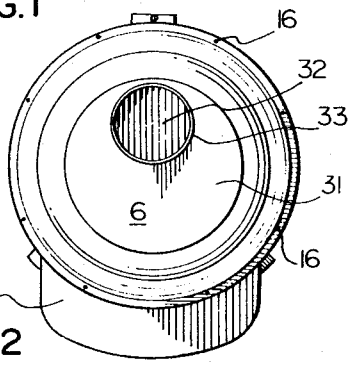
FIG. 2 is a top view of this stove.
Figure 3:
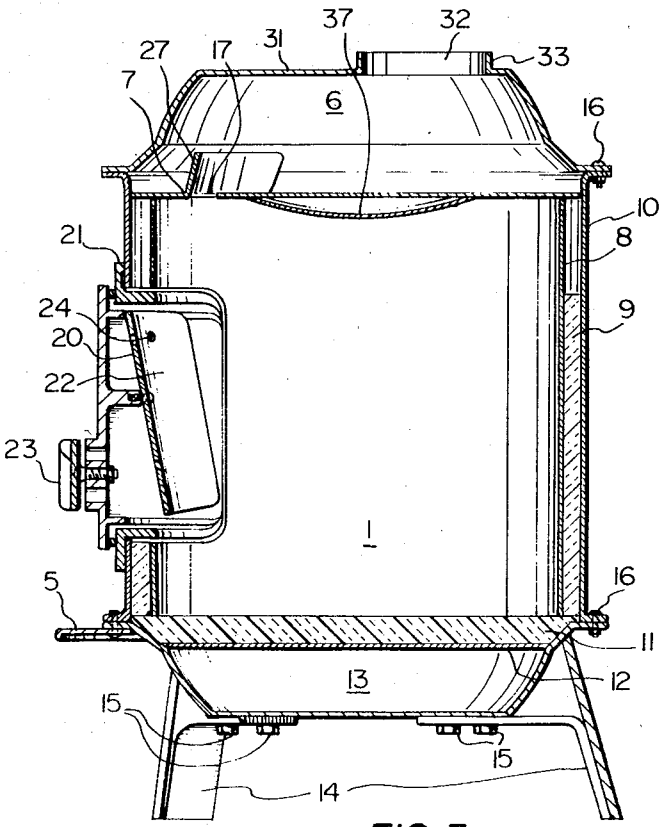
FIG. 3 is a sectional view taken generally along the line 3—3 of FIG. 1.
Figure 4:
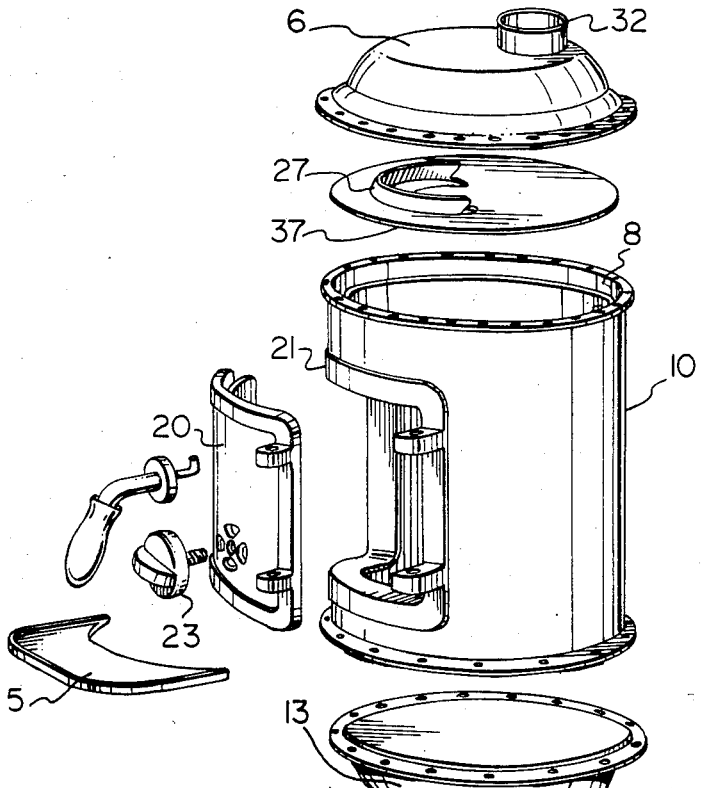
FIG. 4 is an exploded view of this stove showing various components.

With reference to the drawings, the stove comprises a body section 1, a top section 6 and a bottom section 13. The top and bottom sections are frusto-conical in cross-section and are preferably made of mild steel. They are adapted to be attached to the body section 1 by means of nuts and bolts 16. The body section 1 comprises an outer cylinder 10, preferably made of mild steel, and an inner cylindrical 8, preferably made of stainless steel. The space between the inner and outer cylinders is adapted to contain insulation 9. The insulation 9 can be vermiculite, which can easily be poured into the space between the cylinders. It should reach a level above the door frame 21. Alternatively, a fireproof ceramic blanket having a thickness of substantially ¼ inch and a density of substantially 6 pounds can be used.

The top section 6 has a cooking surface 31 and an aperture 32 having a flange 33, adapted to be connected to a stovepipe (not shown).

A baffle 7 is adapted to fit onto the body section 1 by resting on the top of the inner cylinder 8.

The bottom section 13 contains a support 12, adapted to hold firebricks 11. Legs 14 are attached to the bottom section to maintain the stove in an upright position. A tray 5 is secured to the front of the stove to catch any ashes or sparks from the stove.

The door 20 is hingeably connected to a door frame 21. The door 20 and the door frame 21 are preferably made of ductile cast iron. A plate 22 is attached to the inside of the door 20 and a shaft regulator 23 is attached to the exterior of the door 20. The plate 22 is preferably made of stainless steel and acts as a heat shield to keep the door cooler. The door frame 21 is L-shaped and is adapted to cover up the insulation 9 between the inner and outer cylinders.

The door 20 may be replaced by a screen which can be adapted to be hingeably connected to the door frame 21. Although the use of the screen will decrease the efficiency of the stove, it allows for the viewing of the fire.

In operation, the draft regulator 23 is adapted to control the flow of air into the stove for combustion purposes. Some of that air flows under the plate 22 and into the primary combustion chamber 35. The remaining air flows through the holes 24, up through the opening 17 in baffle 7 and into the secondary combustion chamber 36. The opening 17 is arcuate in shape. As the fire in the primary combustion chamber 35 gets hotter, the stove will heat up until combustion begins of the gases in the secondary combustion chamber 36. A heat shield 27 is located at the front of the opening 17. This secondary combustion burns off most of the creosote which may be present in the stove or stove-pipe. The baffle 7 has a dimple 37 which is adapted to collect creosote which may drip down onto the baffle. The dimple also acts to strengthen the baffle to resist warpage during the high temperatures experienced during secondary combustion. During secondary combustion, the surface 31 is ideal for cooking.

Figure 6:
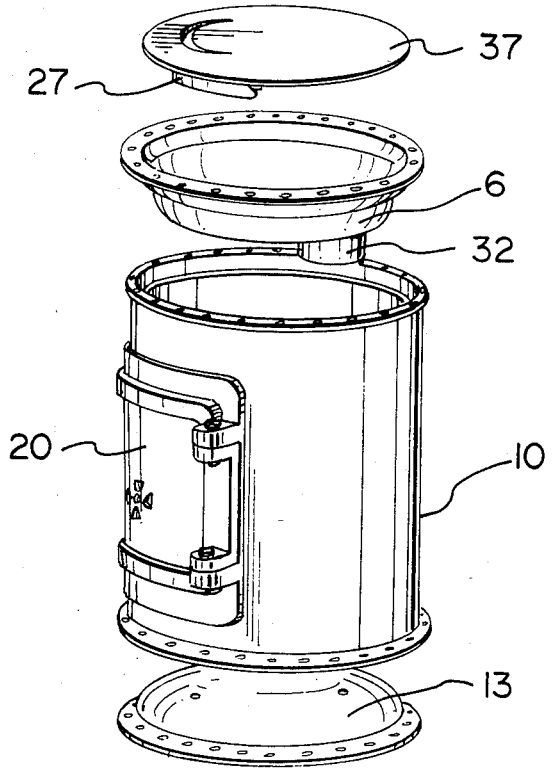
FIG. 6 is an exploded view of the stove in nested form.

The stove which is subject of the present invention can be manufactured in sections which are relatively easy to manufacture. The top section 6 and the bottom section 13 are adapted to nest within the body section 1, as shown in FIG. 6, so that the unassembled stove is more compact for storage or transport purposes. The curved surfaces used throughout the stove greatly reduce the warpage, notwithstanding the use of relatively light weight steel.

Figure 5:
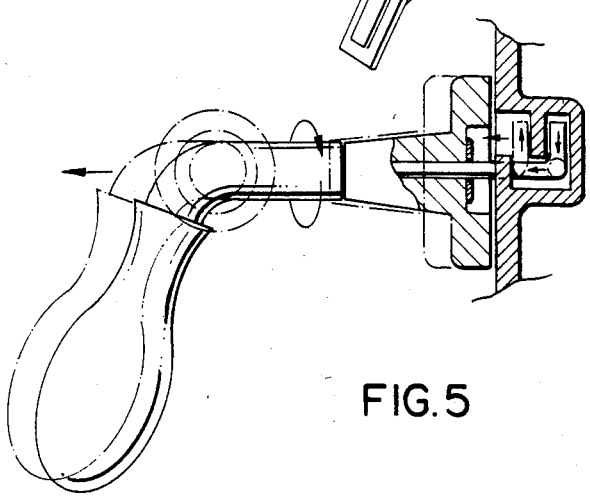
FIG. 5 is a view of the handle and latch mechanism.

As illustrated in FIG. 5, the door assembly includes a two-stage opening means whereby the door can be opened to a predetermined point by turning the door handle in a clock-wise direction and pulling. The door can then be opened fully by turning the door handle in a counter clock-wise direction and pulling the door open. This mechanism is advantageous in that the door cannot be opened fully by one simple motion. In addition, if there were a sudden surge of pressure during the opening of the door, the door would not be forced open fully, possibly causing harm to the person opening the door, but would remain in the first stage.

According to one embodiment of the invention, the stove can be assembled by attaching the legs 14 to the bottom section 13 by means of screws 15. The support plate 12 is installed in the bottom section 13 and the firebrick 11 is placed on top of the plate 12. A paste-type sealant (capable of resisting high temperatures) is then applied around the outer lip of the bottom section 13. The outer cylinder 10 is then placed on the sealant on the outer lip of the bottom section 13, with the door opening being situated between the front legs of the stove and with the bolt holes in the outer cylinder 10 lining up with the bolt holes in the bottom section 13. The tray 5 is stalled and nuts and bolts 16 are used to secure the tray 5, outer cylinder 10 and bottom section 13 to each other. The inner cylinder 8 and the insulation 9 are then installed. The baffle 7 is then installed, being placed on top of the inner cylinder 8, with the opening 17 being located directly behind the openings in the outer and inner cylinders. Sealant is then applied around the outer lip of the top section 6 and the top section is secured to the outer cylinder 10 by means of nuts and bolts 16.

Although only certain embodiments have been illustrated in detail herein, it will be apparent that the invention is capable of still further modification, and that this application is intended to cover any such modifications as may fall within the scope of one skilled in the art or the appended claims.

What I claim is:

1. A freestanding stove comprising a body section, a top section having a combustion gas outlet, a bottom section, a baffle means and a draft regulating means, said body section being cylindrical in shape;

said top and bottom sectons each being substantially frusto-conical and being, for transport or storage purposes, adapted to nest within said body section;

said top section adapted to be secured to one end of said body section and said bottom section adapted to be secured to the opposite end of said body section, said baffle means being located between said body section and said top section whereby said bottom section, said body section and said baffle means together define a primary combustion chamber and said top section and said baffle means together define a secondary combustion chamber;

said draft regulating means comprising at least one adjustable vent opening operable to regulate the flow of air to said combustion chambers;

said baffle means including an arcuate opening to permit the flow of air from said primary combustion chambers to said secondary combustion chamber, an arcuate heat shield in front of said arcuate opening and a dimple for collecting creosote.

2. A stove according to claim 1 wherein said body section comprise an inner cylinder and an outer cylinder, with insulation material therebetween.

3. A stove according to claim 2 wherein said insulation material is vermiculite.

4. A stove according to claim 1 wherein said bottom section is provided with firebrick insulation.

5. A stove according to claim 2, 3, or 4 wherein said inner cylinder is mild steel.

6. A stove according to claim 2, 3, or 4 wherein said outer cylinder is mild steel.

7. A stove according to claim 2 wherein said insulation material is a fireproof ceramic blanket having a thickness of about $\frac{1}{4}$ inch and a density of about 6 pounds.

* * * * *